US008276789B2

(12) United States Patent
Emenheiser

(10) Patent No.: US 8,276,789 B2
(45) Date of Patent: Oct. 2, 2012

(54) HEAT TRANSFER APPARATUS

(76) Inventor: Matthew C. Emenheiser, Golden, CO (US)

( * ) Notice: Subject to any disclaimer, the term of this patent is extended or adjusted under 35 U.S.C. 154(b) by 616 days.

(21) Appl. No.: 12/477,134

(22) Filed: Jun. 3, 2009

(65) Prior Publication Data

US 2010/0307715 A1 Dec. 9, 2010

(51) Int. Cl.
*B67D 7/84* (2010.01)

(52) U.S. Cl. ..... 222/175; 224/148.1

(58) Field of Classification Search ..... 222/175, 222/372, 633, 634, 209, 213, 214; 224/148.1, 224/148.2
See application file for complete search history.

(56) References Cited

U.S. PATENT DOCUMENTS 4,022,347 A * 5/1977 Noble ..... 222/1
4,629,098 A * 12/1986 Eger ..... 222/175
5,645,404 A * 7/1997 Zelenak ..... 417/1
6,981,613 B1 * 1/2006 Kamisugi ..... 222/105
7,007,502 B2 * 3/2006 Kreutzmann et al. ..... 62/457.3
7,509,692 B2 * 3/2009 Elkins et al. ..... 2/458
7,820,946 B2 * 10/2010 Woodfill et al. ..... 219/214
7,971,549 B2 * 7/2011 Skillern et al. ..... 114/347
8,083,105 B2 * 12/2011 Reichert et al. ..... 222/175

* cited by examiner

*Primary Examiner* — Lien Ngo
(74) *Attorney, Agent, or Firm* — Roger A. Jackson

(57) ABSTRACT

A heat transfer apparatus for a portable hydration system that includes a reservoir, a first check valve, a manual pump activated by user movement, a second check valve, a first fluid communication line including a proximal end in communication with the second check valve and a distal end in communication with a bleed valve, further included is a second fluid communication line including an inlet end in communication in the bleed valve and an outlet end in communication with the reservoir. The first fluid communication line and the second fluid communication line are continuously adjacent in position to one another, wherein the bleed valve discharges a selectable intermittent fluid flowrate to the user for consumption and the pump outputs a primary intermittent fluid flowrate greater than the selectable intermittent fluid flowrate, wherein operationally the heat transfer apparatus acts to further help equalize the reservoir and the bleed valve temperatures.

13 Claims, 5 Drawing Sheets

HEAT TRANSFER APPARATUS

RELATED APPLICATIONS

There are no related applications.

TECHNICAL FIELD

The present invention generally relates to a portable hydration apparatus used typically by an individual engaged in a sport related activity. More particularly, the present invention is a heat transfer apparatus that forms a part of a portable hydration apparatus, wherein the portable hydration apparatus is used in a below freezing environment and has a problem of a mouthpiece and potentially the associated fluid communication line freezing that extends from the hydration apparatus reservoir, thus rendering the hydration apparatus non-functional.

BACKGROUND OF INVENTION

Typical personal hydration systems usually include a backpack type structure for removably engaging to the individual user. This backpack type structure makes for the most stable and secure attachment system when supporting a fair amount of weight, from the drinking fluid in the reservoir, while the individual is participating in sports activities, such as bicycling, hiking, skiing, snowboarding, and the like. Extending from the reservoir that is usually disposed in the center of the backpack structure (for the best center of gravity disposition) is the fluid line communication typically in the form of a flexible tube being about one-half inch in diameter, wherein the tube terminates in a mouthpiece with a "bite valve", wherein the individual user can open the valve in a "hands free" manner to drawing drinking fluid from the reservoir through the tube and mouthpiece into their mouth, while utilizing both hands for their sporting activity.

Even though the backpack structure and reservoir combination works well for supporting the somewhat heavy reservoir while the individual is active, an inherent design drawback is that the distance from the reservoir to the user's mouth is long which causes a number of problems, firstly by making hard to suck the fluid through such a long "straw" plus pulling the upward as against gravity, wherein these issues can be enervated by mounting the reservoir higher (for less gravity effect), having a larger diameter tube (for less fluid flow loss), or even pressurizing the reservoir interior by either adding force against the exterior of the reservoir (as the reservoir is typically a flexible member) or internally pressurizing the reservoir, all in an effort to help the drinking fluid flow from the reservoir to the mouthpiece. Another problem made worse by the long tube occurs in freezing weather, wherein the tube having little thermal mass in typically the worst aspect ratio possible for maximum heat transfer (wherein high heat transfer is undesirable for the freezing environment removing residual heat from the tube) in that the tube has a high surface area to volume ratio by being essentially a long skinny cylinder, all this adds up to the long tube being especially vulnerable to freezing, thus causing the hydration apparatus to be worthless.

Of course insulation can be added to somewhat lessen the tube freezing problem by lengthening the amount of time it takes to freeze the tube, however the insulation around the tube suffers from the same high surface area to volume ratio in that the farther the tube is from the reservoir, the less benefit of the insulation, further the adds bulk and weight, both negatives. The insulation could be heated which would make it effective as against freezing, however, the high relative amount of energy required would go against portability is every respect, against by adding bulk and weight, i.e. batteries, chemicals, controls, complexity, and so on. Furthermore, there exists the problem of the mouthpiece being exposed and subject to freezing as the mouthpiece cannot be insulated easily as it need to be exposed to the user's mouth, plus the mouthpiece being the furthest in distance from the reservoir has the least benefit from reservoir heat.

These aforementioned issues have been recognized in the prior art and a number of solutions have been put forth, starting with United States patent application publication number 2006/0151534 to Mares disclosed is an example of a separate heating element applied to the tube portion of the hydration system, broadly Mares is a freeze resistant hydration system directed to personal hydration systems that are adapted to maintain the temperature of the drinking fluid in a desired range during use of the hydration systems in spite of ambient conditions that may be colder or hotter than the desired temperature range. For example, in Mares the personal hydration systems within the scope of the present disclosure may resist or prevent freezing of the drink fluid in cold or freezing weather conditions. The hydration system in Mares includes a fluid reservoir that is adapted to receive and contain a volume of potable drink fluid with an elongated downstream assembly that extends from the reservoir and enables a user to draw drink fluid from the reservoir, such as by sucking upon a mouthpiece that may form a portion of the downstream assembly. The downstream assembly in Mares may include a plurality of fluidly interconnected components, and typically will include at least an end region that fluidly interconnects the downstream assembly with the reservoir, at least one length of drink tubing through which the drink fluid may flow, and a mouthpiece or other outlet from which the drink fluid may be dispensed from the hydration system.

Further in Mares, the reservoir, and typically a portion of the downstream assembly, is housed within a pack, the pack includes a strap assembly with at least one body-mounting strap, such as a pair of shoulder straps. Unlike conventional packs, the present hydration system in Mares includes a pack, reservoir, and/or downstream assembly adapted to be insulated against ambient conditions and, in some embodiments, to be selectively configured with a heating region to heat the drink fluid and/or for cold weather use to resist freezing of the drink fluid. The reservoir containing the volume of drink fluid in Mares may be configured to insulate the stored drink fluid from the ambient conditions. Additionally, in Mares portions of the downstream assembly may be insulated or include insulating features, with the pack of the present hydration system including one or more straps configured to selectively store, or enclose, at least a portion of the downstream assembly in a drink tube sleeve. When present, in Mares, the straps that are configured to selectively store the downstream assembly may include a heating region disposed along at least a length, or region, of the strap, the heating region may be configured to supply heat to the mouthpiece of the downstream assembly and may also be configured to supply heat to the flexible tubing of the downstream assembly. The heating region in Mares may include one or more pockets configured to receive a heat source, such as may be adapted to heat portions of the downstream assembly that are stored within the corresponding strap, see Page 1, paragraph 0004 and 0005. Note that in Mares the need for a separate heat source is a drawback as previously described, by adding complexity and bulk.

Continuing in the prior art in this area, in United States patent application publication number 2007/0084844 to Woodfill, et al. disclosed is a portable hydration system similar to Mares in that a separate heating element is utilized with the previous problems of bulk, weight, and complexity, broadly Woodfill et al. includes a conduit coupled to a valve and a reservoir, wherein the conduit and the valve facilitate human consumption of fluid in the reservoir. The system in Woodfill et al., also includes an active heating assembly to prevent the fluid from freezing while in the conduit and the valve, the active heating assembly may include a temperature sensor to detect the temperature of the conduit and/or the fluid in the conduit, a heating element to heat the conduit and a controller coupled to the temperature sensor and the heating element to control heating of the conduit. In one example, in Woodfill et al., the controller has a microprocessor and a power source such as a direct current (DC) power source. In another example in Woodfill et al., the active heating assembly may include a chemical pack solution that generates heat when manipulated or broken. In either example in Woodfill et al., the active heating assembly can convert one form of energy into heat rather than merely attempting to trap in preexisting heat with insulation, see Page 1, paragraph 0021.

Further, in an indirect prior art area, however utilizing like principals in U.S. Pat. No. 7,509,692 to Elkins, et al. disclosed is a wearable personal cooling and hydration system which can be worn by the user and both provides cooling for the user and a source of drinkable fluid to augment the body's natural temperature control systems. In Elkins et al., a vest and cap or other garment is worn by the user which includes a heat transfer fluid pathway extending there through, wherein the heat transfer fluid passes through this pathway and absorbs heat from the wearer who is engaged in being active while participating in a sports activity in warmer weather. Preferably, in Elkins et al., this garment is in the form of both a vest and a cap so that heat absorption into the heat transfer fluid and cooling for the wearer can be maximized, this thus user body heated heat transfer fluid is then routed to a heat sink where the heat transfer fluid is cooled and the heat in the heat transfer fluid is passed to the heat sink material.

In Elkins et al., the heat sink is preferably in the form of a removable cartridge which can be borne by the wearer, preferably within a backpack, this heat sink cartridge is preferably a water or other drinkable fluid container which begins in the form of ice. As the heat transfer fluid draws heat away from the wearer and delivers it to the heat sink, the ice melts. A drinking tube in Elkins et al., is coupled to an outlet of the cartridge so that the wearer (or others) can utilize the drinking tube to drink fresh recently melted ice water. The cooled heat transfer fluid in Elkins et al., then returns back to the garment for further cooling of the wearer, most preferably, not all of the heat transfer fluid is routed to the heat sink, such as the water/ice filled cartridge. Rather, in Elkins et al., two parallel paths are provided for the heat transfer fluid, including a hot path which bypasses the heat sink and a cold pack which is routed to the heat sink, a temperature control valve divides the flow of heat transfer fluid between the hot and the cold path to provide mixing of the two streams. Preferably, in Elkins et al., this temperature control valve is adjustable by the user, so that the user can select the amount of heat transfer fluid which is cooled, and correspondingly control a rate at which heat is drawn from the wearer and delivered to the heat sink; see Column 2, lines 7-42.

Continuing further, in the hydration system arts, in U.S. Pat. No. 7,490,740 to Robins, et al., disclosed a personal hydration system for delivering a fluid for consumption by a user, wherein this system has no accommodation for freezing weather, as it is an example of a typical portable hydration system. The personal hydration system in Robbins et al., includes a semi-rigid reservoir and a holder configured to receive the reservoir and couple the reservoir to a user. A fluid delivery system in Robbins et al., is provided to interface with the reservoir to provide a substantially airtight flow path to transport fluid from the reservoir to the user, see Column 2, lines 64-67, and Column 3, lines 1-4. A further embodiment in Robbins et al., includes a personal hydration system including a reservoir having a semi-rigid structure configured to contain fluid to be consumed by the user, including a backpack to be worn by the user having a first space for receiving the reservoir and a second space to receive objects. In Robbins et al., the structure of the reservoir provides a frame configured to maintain the backpack in a generally predetermined shape, see Column 3, lines 50-57.

Next, in the portable hydration systems arts, in U.S. Pat. No. 7,464,837 to Hoskins disclosed is a hydration delivery tube system, wherein this system also has no accommodation for freezing weather, as it is an example of a typical portable hydration system including a fluid delivery tube with mouthpiece, and a retraction member connected to the fluid delivery tube. The fluid delivery tube in Hoskins is connected to a fluid reservoir, such as a polyurethane bladder, plastic laminate pouch, or polyethylene container. In Hoskins, the hydration delivery tube system and the reservoir can be placed into a wearable pack so that the delivery tube can accessed through an opening and/or channel incorporated into the pack, see Column 1, lines 10-18.

Continuing further, also in the portable hydration system arts, in United States patent application publication number 2008/0217367 to Lillie disclosed is a backpack including an elongated fluid reservoir being positioned adjacent to a user's hip region, wherein a hip belt compresses the reservoir against the hips of the user to assist in providing fluid to the user similar to squeezing a flexible water bottle to enhance the drinkable flowrate out of an opening to the user.

There remains a need for a more practical system for making the portable hydration apparatus useful when the user is exposed to freezing environmental conditions for extended periods that doesn't require additional heat energy input, power requirements or components, with their added complexity in order to keep the tube and mouthpiece from freezing and thus making the portable hydration apparatus unusable. A desirable anti-freezing system for the portable hydration apparatus would not require any outside energy use and would also minimize any added weight or bulk added to the portable hydration apparatus by utilizing the existing motion of the user and stored heat energy available in the reservoir.

SUMMARY OF INVENTION

Broadly, the present invention is of a heat transfer apparatus for a portable hydration system having a user, wherein the heat transfer apparatus and the portable hydration system are located within an environment, the heat transfer apparatus and the portable hydration system including a reservoir, a first check valve in fluid communication with the reservoir, wherein the first check valve is oriented such that only flow from the reservoir is facilitated. Further included in the heat transfer apparatus for a portable hydration system is a pump having an inlet port and an outlet port, wherein the inlet port is in fluid communication with the first check valve, also included is a second check valve in communication with the outlet port, wherein the second check valve is oriented such that only flow from the pump is facilitated.

Further included in the heat transfer apparatus for a portable hydration system is a first fluid communication line including a proximal end portion and a distal end portion having a first fluid communication line length and first longitudinal axis therebetween, wherein the proximal end portion is in fluid communication with the second check valve, also included is a second fluid communication line including an inlet end portion and an outlet end portion having a second fluid communication line length and second longitudinal axis therebetween. Furthermore, the first fluid communication line length and the second fluid communication line length are continuously adjacent in position to one another, wherein the distal end portion and the inlet end portion are in fluid communication with one another and the outlet end portion is in fluid communication with the reservoir.

Further included in the heat transfer apparatus for a portable hydration system is a bleed valve in fluid communication with the distal end portion, wherein the bleed valve discharges a selectable intermittent fluid flowrate to the user for consumption and the pump outputs a primary intermittent fluid flowrate that is greater than the intermittent fluid flowrate, wherein operationally the heat transfer apparatus acts to further help equalize the reservoir and the bleed valve temperatures.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
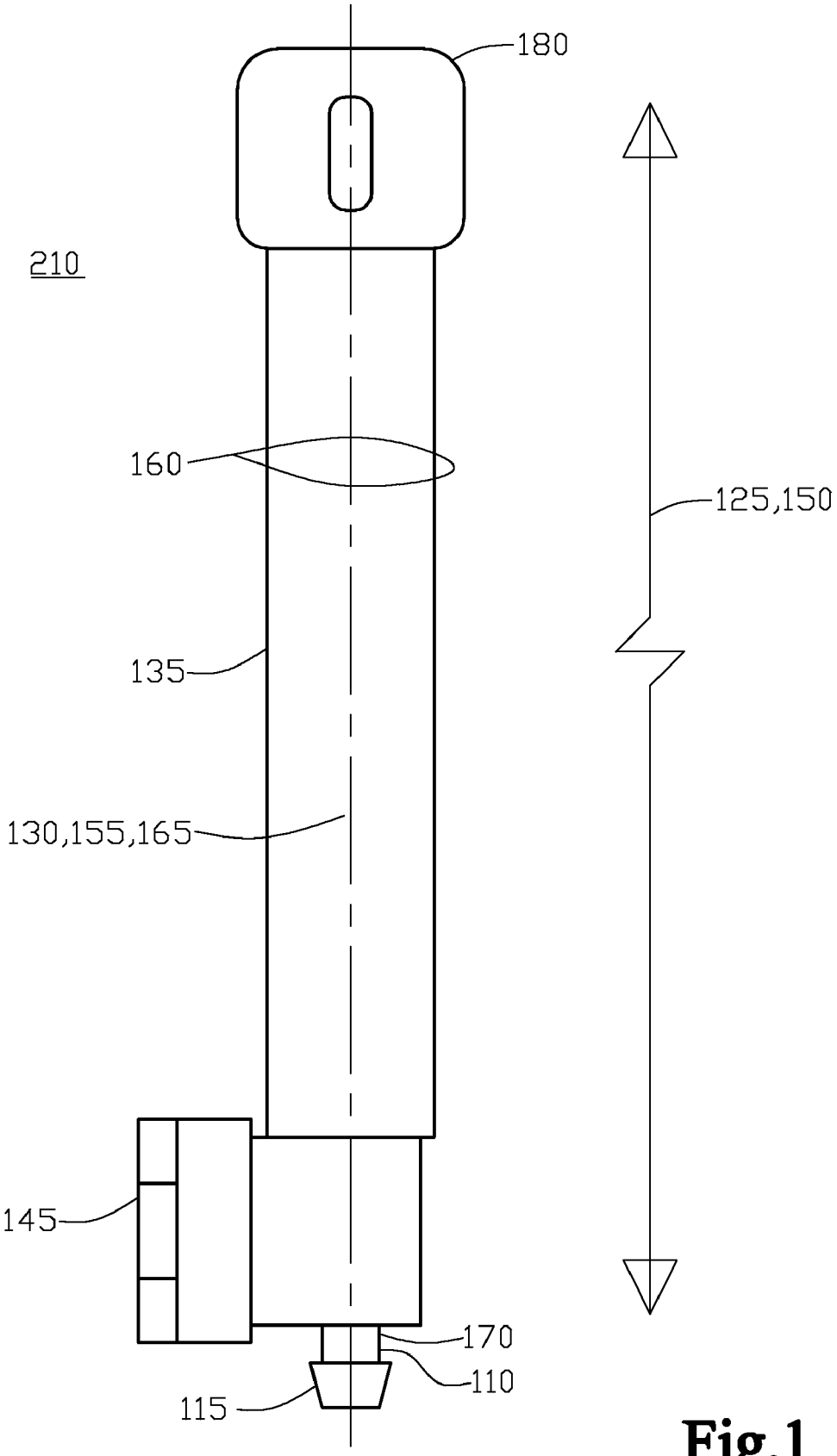
FIG. 1 shows an external side elevation view of the first fluid communication line, the second fluid communication line, and the bleed valve, in conjunction with the length of the first and second fluid communication lines with their first and second longitudinal axes.

30 Heat transfer apparatus
35 Portable hydration system
40 Reservoir
45 First check valve
50 Orientation of first check valve 45 such that only flow from the reservoir 40 is facilitated
55 Pump
60 Inlet port of pump 55
65 Outlet port of pump 55
70 Flexible bulb of pump 55
75 Primary intermittent fluid flowrate of the pump 55
76 Primary return intermittent fluid flowrate of the pump 55 to the reservoir 40 which will be substantially equal to flowrate 75 when the bleed valve 180 is in the closed operational state with no flowrate 185, wherein the primary return intermittent fluid flowrate will be less than flowrate 75 by an amount equal to flowrate 185 from valve 180 when the valve 180 is in the open operational state
80 Intermittent compressive force as placed upon the pump 55
85 Sizing and configuring of the pump 55 to create the intermittent compressive force 80 from the user's 190 body movement 195
90 Second check valve
95 Orientation of second check valve 90 such that only flow from the pump 55 is facilitated
100 Third check valve
105 Orientation of third check valve 100 such that only flow into the reservoir 40 is facilitated
110 First fluid communication line
115 Proximal end portion of the first fluid communication line 110
120 Distal end portion of the first fluid communication line 110
125 Length of first fluid communication line 110
130 First longitudinal axis of first fluid communication line 110
135 Second fluid communication line
140 Inlet end portion of the second fluid communication line 135
145 Outlet end portion of the second fluid communication line 135
150 Length of second fluid communication line 135
155 Second longitudinal axis of second fluid communication line 135
160 Continuously adjacent position of the first fluid communication line 110 and the second fluid communication line 135
165 Coaxial positional relationship as between the first longitudinal axis 130 and the second longitudinal axis 155
170 Disposing of the first fluid communication line 110 within the second fluid communication line 135
175 Minimal temperature differences between the first fluid communication line 110, the second communication line 135, and the environment 210
180 Bleed valve
181 Manual operation of bleed valve 180
182 Recirculation of fluid flow within bleed valve 180
185 Discharge of a selectable intermittent fluid flowrate by the bleed valve 180 when valve 180 is in the open operational state, this flowrate 185 will be substantially zero when the valve 180 is in the closed operational state

190 User
195 User's 190 body movement
200 Closely fitting backpack
205 Securing backpack 200 to user 190
210 Environment

DETAILED DESCRIPTION

Figure 2:
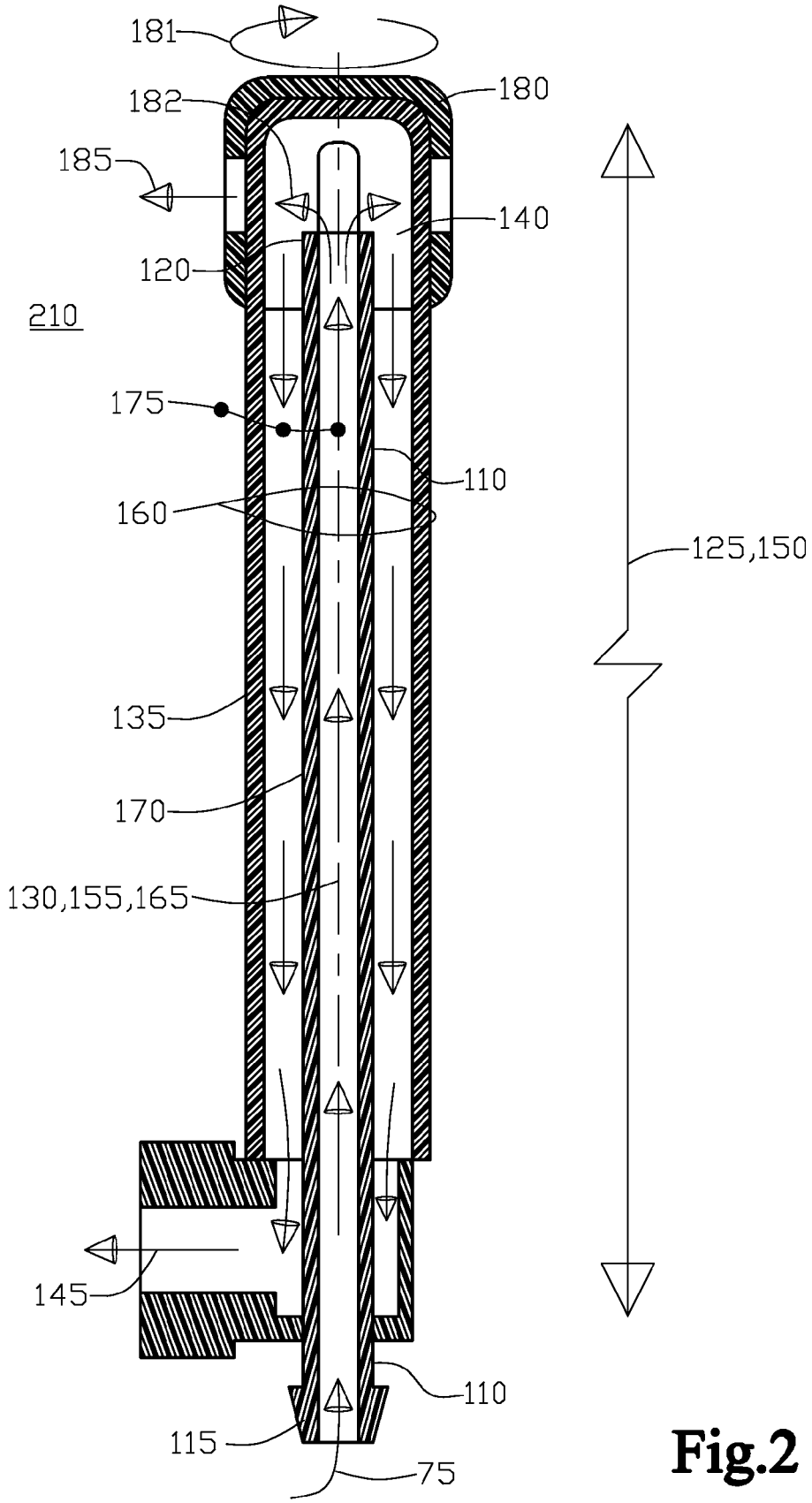
FIG. 2 shows a cross sectional view of FIG. 1 with the first fluid communication line, the second fluid communication line, and the bleed valve, in conjunction with the length of the first and second fluid communication lines with their first and second longitudinal axes, in addition to the fluid flow from the proximal end portion to the distal end portion of the first fluid communication line, recirculation through the bleed valve in the closed operational state, where the bleed valve has discharge selectable intermittent flowrate, if the bleed valve is in the open operational state (not shown), and continuing the flowrate from the bleed valve recirculation into the inlet end portion through the second fluid communication line to the outlet end portion.

With initial reference to FIG. 1 shown is an external side elevation view of the first fluid communication line 110, the second fluid communication line 135, and the bleed valve 180, in conjunction with the length of the first 125 and second 150 fluid communication lines with their first 130 and second 155 longitudinal axes. Continuing, FIG. 2 shows a cross sectional view of FIG. 1 with the first fluid communication line 110, the second fluid communication line 135, and the bleed valve 180, in conjunction with the length of the first 125 and second 150 fluid communication lines with their first 130 and second 155 longitudinal axes. Also, in FIG. 2, the fluid flow 75 is from the proximal end portion 115 to the distal end portion 120 of the first fluid communication line 110, recirculation 182 is shown through the bleed valve 180 in the closed operational state, wherein the bleed valve 180 has discharge selectable intermittent flowrate 185, if the bleed valve 180 is in the open operational state (not shown, as the bleed valve 180 is shown in the closed operational state in FIG. 2), and continuing onward the flowrate from the bleed valve recirculation 182 into the inlet end portion 140 through the second fluid communication line 135 to the outlet end portion 145.

Figure 3:
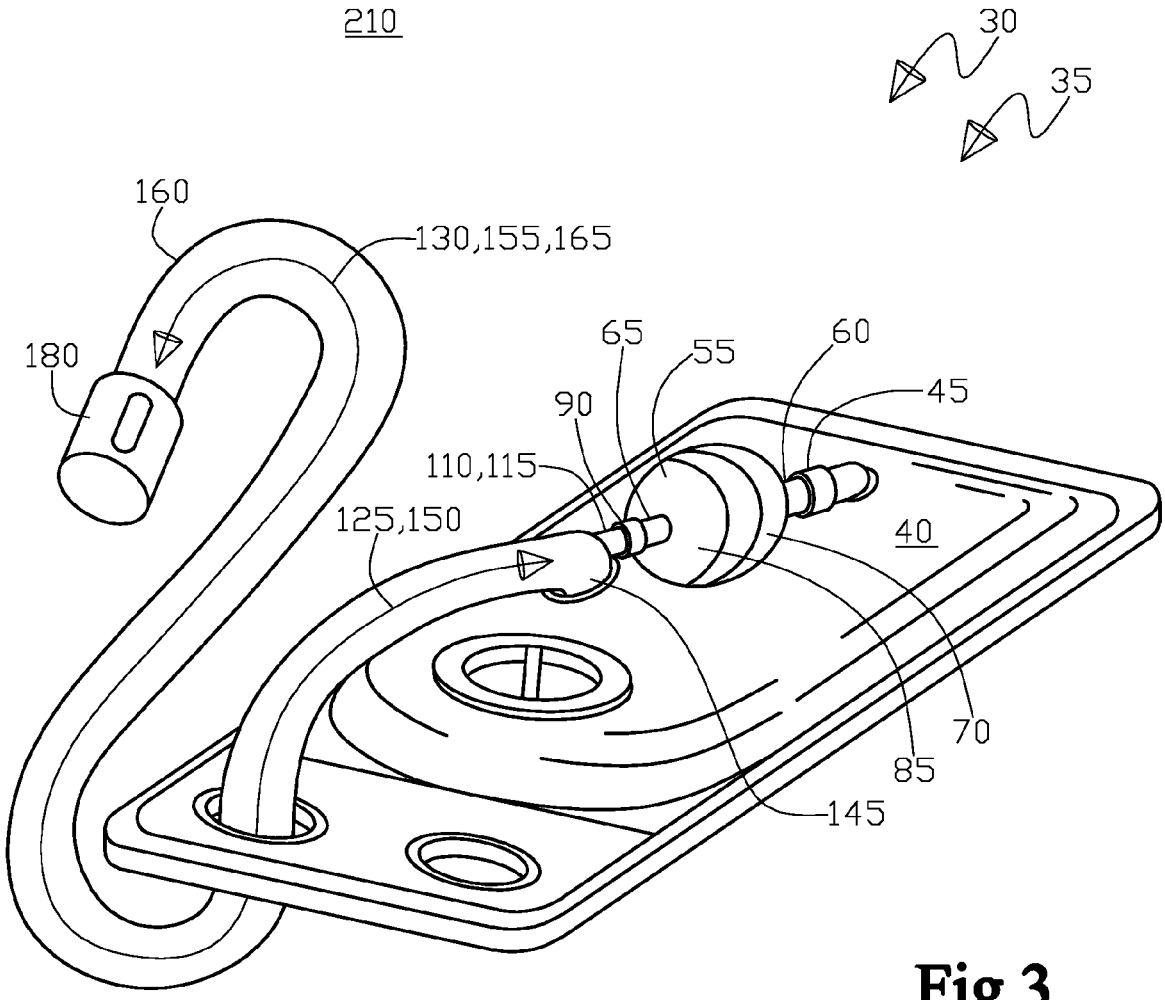
FIG. 3 shows a perspective view of the reservoir, the first check valve, the pump, the second check valve, the combined first fluid communication line and second fluid communication line at their length with the bleed valve.

Moving forward, FIG. 3 shows a perspective view of the reservoir 40, the first check valve 45, the pump, the second check valve 90, the combined first 110 fluid communication line and second 135 fluid communication line at their length 125 and 150 with the bleed valve 180. Further, FIG. 4 shows a fluid schematic of the heat transfer apparatus 30 and portable hydration system 35 including the backpack 200, reservoir 40, the first 45, second 90, and third 100 check valves, the pump 55, the first fluid communication line 110, the second fluid communication line 135, and the bleed valve 180.

Figure 5:
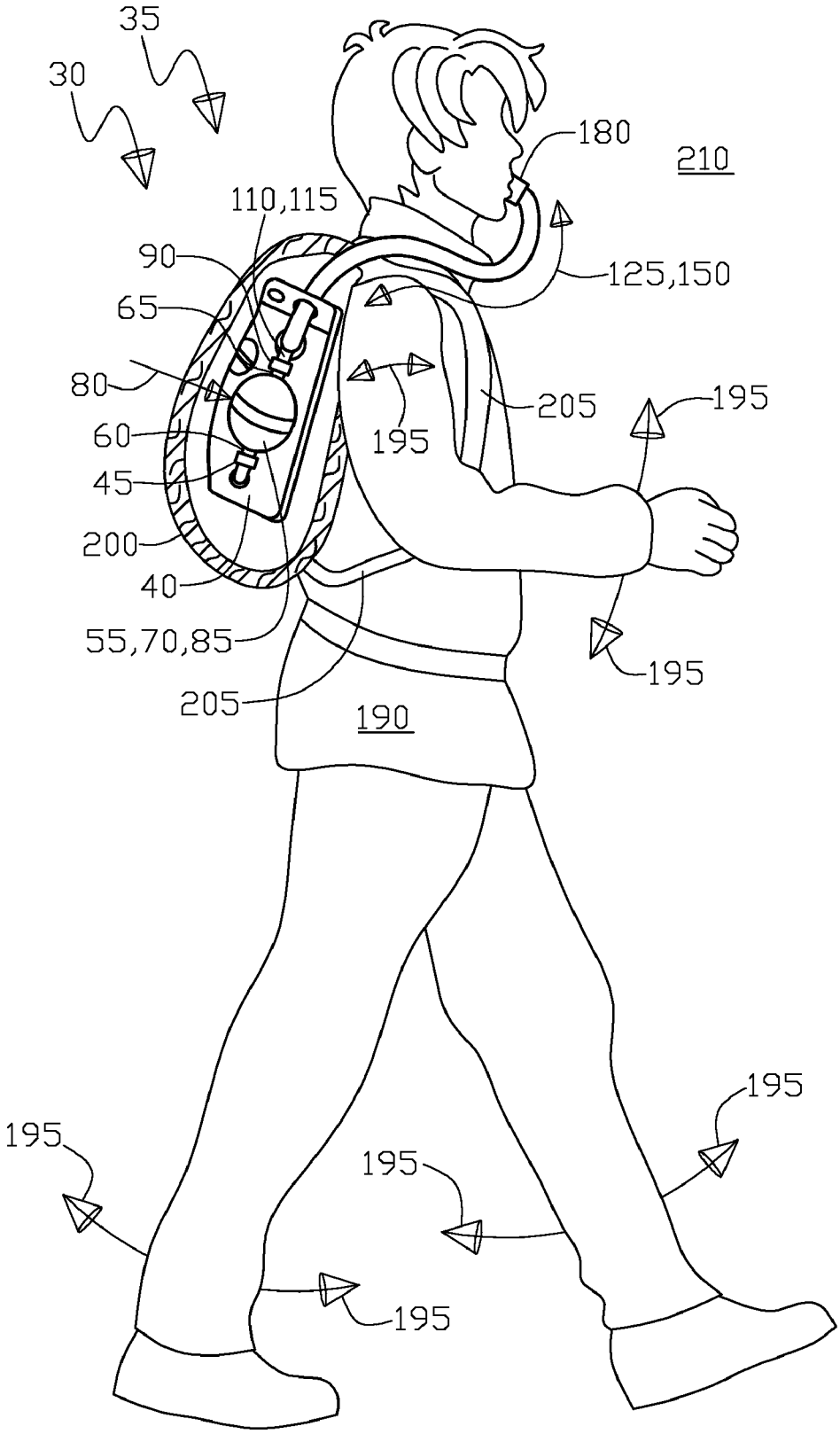
FIG. 5 shows a use side elevation drawing with the user wearing the backpack showing the reservoir, first and second check valves, the pump, the combined first and second fluid communication lines with the bleed valve, wherein the user is engaging in body movement to effectuate intermittent compressive force upon the pump for the purpose of creating a primary intermittent fluid flowrate from the pump through the first fluid communication line, the bleed valve, the second fluid communication line and returning to the reservoir.

Next, FIG. 5 shows a use side elevation drawing with the user 190 wearing the backpack 200 showing the reservoir 40, first 45 and second 90 check valves, the pump 55, the combined first 110 and second 135 fluid communication lines with the bleed valve 180, wherein the user 190 is engaging in body movement 195 to effectuate intermittent compressive force 80 upon the pump 55 for the purpose of creating a primary intermittent fluid flowrate 75 from the pump 55 through the first fluid communication line 110, the bleed valve 180, the second fluid communication line 135 and returning to the reservoir 40.

Broadly, the present invention is of a heat transfer apparatus 30 for a portable hydration system 35 having a user 190, wherein the heat transfer apparatus 30 and the portable hydration system 35 are located within an environment 210, such as the outdoors, typically in freezing weather conditions. The heat transfer apparatus 30 and the portable hydration system 35 including a reservoir 40, a first check valve 45 in fluid communication with the reservoir 40, wherein the first check valve 45 is oriented such that only flow 50 from the reservoir 40 is facilitated. Further included in the heat transfer apparatus 30 for a portable hydration system 35 is a pump 55 having an inlet port 60 and an outlet port 65, wherein the inlet port 60 is in fluid communication with the first check valve 45, also included is a second check valve 90 in communication with the outlet port 65, wherein the second check valve 90 is oriented such that only flow 95 from the pump 55 is facilitated, as best shown in the fluid schematic in FIG. 4.

Figure 4:
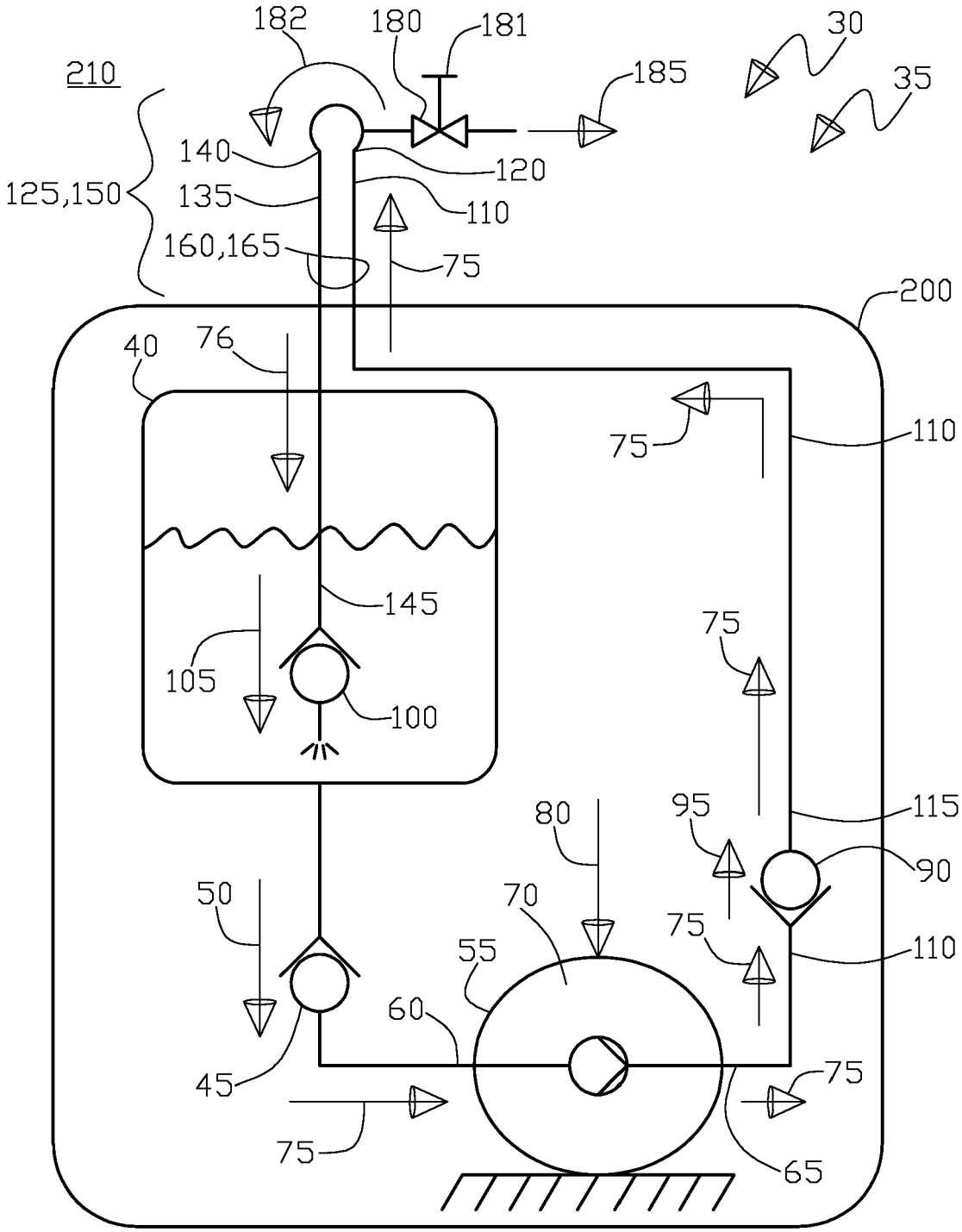
FIG. 4 shows a fluid schematic of the heat transfer apparatus and portable hydration system including the backpack, reservoir, the first, second, and third check valves, the pump, the first fluid communication line, the second fluid communication line, and the bleed valve.

Further included in the heat transfer apparatus 30 for a portable hydration system 35 is a first fluid communication line 110 including a proximal end portion 115 and a distal end portion 120 having a first fluid communication line length 125 and first longitudinal axis 130 therebetween, wherein the proximal end portion 115 is in fluid communication with the second check valve 90, again as best shown in the fluid schematic in FIG. 4, and further in FIGS. 1 and 2 for the first fluid communication line 100 in particular. Also included in the heat transfer apparatus 30 for a portable hydration system 35 is a second fluid communication line 135 including an inlet end portion 140 and an outlet end portion 145 having a second fluid communication line length 150 and second longitudinal axis 155 therebetween. Furthermore, the first fluid communication line length 125 and the second fluid communication line length 150 are continuously adjacent 160 in position to one another, wherein the distal end portion 120 and the inlet end portion 140 are in fluid communication with one another and the outlet end portion 145 is in fluid communication with the reservoir 40, see FIG. 4 for the fluid schematic and FIGS. 1 and 2, for the interior and exterior of the combination of the first fluid communication line 110 and the second fluid communication line 135.

Also included in the heat transfer apparatus 30 for a portable hydration system 35 is a bleed valve 180 in fluid communication with the distal end portion 120, wherein the bleed valve 180 discharges a selectable intermittent fluid flowrate 185 to the user 200 for consumption and the pump 55 outputs a primary intermittent fluid flowrate 75 that is greater than the selected intermittent fluid flowrate 185, wherein operationally the heat transfer apparatus 30 acts to further help equalize the reservoir 40 and the bleed valve 180 temperatures, again see FIG. 4 for the fluid schematic and FIGS. 1 and 2 for detail of the first and second fluid communication lines, and further FIG. 3 for an assembled perspective view of the FIG. 4 assembly of the heat transfer apparatus 30 for a portable hydration system 35. In other words the pump 55 outputs a flow rate 75 drawing from the reservoir 40 to the bleed valve 180, wherein the bleed valve 180 is selectably placed into the open state by the user 200, wherein the bleed valve 180 draws off a portion of the flow rate 75 in the form of flowrate 185 for user consumption, note that bleed valve 180 is only shown the closed operational state, see FIG. 2, however, it is within ordinary skill to envision bleed valve in the open state. Thus, even when bleed valve 180 is in the closed operational state as shown in FIG. 2, the pump 55 outputs flowrate 75 for a recirculation system from the reservoir 40 to the reservoir 40 so as to prevent a long term deadhead fluid condition in the bleed valve 180, that could risk freezing of the bleed valve 180 in a freezing environment 210, as the bleed valve 180 has the highest risk of freezing as it is the farthest from the reservoir and by its very nature exposed to the freezing environment 210, as the user needs access to an un insulated bleed valve 180. Note the bleed valve 180 could be many types of valves, some of which may be "hands free" in use for sports activities by the user 190 wearing the portable hydration system 35 incorporating the heat transfer apparatus 30, such as bite valves, duckbill valves, twist valves, pinch valves, and the like, see the usage FIG. 5 for the heat transfer apparatus 30 for a portable hydration system 35 for example.

Looking at further detail of the first 110 and second 135 fluid communication lines as best shown in FIGS. 1 and 2, for the heat transfer apparatus 30 for a portable hydration system 35 wherein the continuously adjacent position 160 of the first fluid communication line 110 and the second fluid communication line 135 are further positioned such that the first fluid communication line 110 and the second fluid communication line 135 are in a co-axial positional relationship 165 to one another as between the first longitudinal axis 130 and the second longitudinal axis 155, as best shown in FIG. 2, as being for user 190 convenience to neatly converge the first 100 and second 135 fluid communication lines, as best shown in FIGS. 3 and 5. Note that as shown in FIGS. 1 and 2, the first 110 and second 135 fluid communication lines are length adjusted to a shorter distance at 125 and 150 for drawing clarity, as the preferred length 125 and 150 can be longer as FIGS. 3 and 5 depict, in addition to being flexible for user 190 convenience while the heat transfer apparatus 30 for a portable hydration system 35 are in use.

Further, on the heat transfer apparatus 30 for a portable hydration system 35 the previously described co-axial positional relationship 165 is preferably arranged such that the first fluid communication line 110 is disposed within 170 the second fluid communication line 135; see in particular FIG. 2 for a cross sectional detail and FIG. 1 for an external view. This positional relationship 170 being operational such that differential temperatures 175 are minimized as between the first fluid communication line 110, the second fluid communication line 135, and the environment 210. The purpose of this arrangement is to minimize heat loss to the environment 210, or what could be called the "sink" wherein outside weather temperatures are at or below freezing wherein the user 190 is utilizing the heat transfer apparatus 30 for a portable hydration system 35 is a sports activity as shown in FIG. 5. As the "sink" is at the lowest assumed relative temperature, and the reservoir is at the highest relative temperature there is the most efficient manner in which to utilize the relative heat from the reservoir to keep the bleed valve 180 from freezing with the user consumption fluid being typically water or a fluid with freezing characteristics similar to water, because if the bleed valve 180 freezes with fluid it becomes unusable.

Thus in order to move or transport the relatively warmer reservoir 40 fluid to the bleed valve 180 over the length 125/150 with minimal loss of heat energy to the sink, temperature differences would need to be minimized between three fluids, firstly the warmest reservoir fluid, the relatively colder fluid that is exiting from the bleed valve 180, and the coldest fluid being the atmospheric air. Thus this results in the order of the fluids resulting from the first fluid line 110 being disposed within the second fluid line 135, wherein conceptually the second fluid line 135 is disposed within the atmospheric air, and in that order respectively being the relatively warmest fluid (in the first fluid line 110 from the reservoir 40), the intermediate temperature fluid (in the second fluid line 135 from the bleed valve 180), and the lowest relative temperature fluid (the atmospheric air). Thus, heat energy loss from the reservoir 40 being pumped 55 therethrough 75 the first fluid line 110 to the bleed valve will be minimized, and with the relatively colder fluid exiting from the bleed valve 180 will return to the reservoir 40 essentially acting as an insulating sheath for the opposing flow direction coming from the reservoir 40 to the bleed valve 180 via the first fluid communication line 110, wherein the relatively colder fluid going from the bleed valve 180 to the reservoir 40 will be warmed by the larger fluid volume of the reservoir 40.

Continuing, on the heat transfer apparatus 30 for a portable hydration system 35 the pump 55 is a manual type utilizing intermittent compressive force 80 to provide energy for the primary intermittent fluid flowrate 75, see FIG. 4 schematically, and FIG. 5 for the utilization of the compressive force 80 on the manual pump, meaning that there is no power or external energy assist for the pump 55. Further, on the heat transfer apparatus 30 for a portable hydration system 35, the pump 55 is sized and configured 85 to create pumping flow 75 from the intermittent compressive force 80 from the user's 190 body movement 195, wherein operationally the heat transfer apparatus 30 and the portable hydration system 35 function solely on user 190 body movement 195, again as best shown in combining FIG. 4 and FIG. 5. This attempts to overcome the drawback of the heat transfer circulation system, being the need for some motive force to create circulation of the relatively warmer reservoir 40 fluid out to the bleed valve 180 via the first fluid communication line 110 and return the relatively cooler fluid from the bleed valve 180 via the second fluid communication line 135 back to the reservoir 40 to warm up to previous relatively cooler bleed valve 180 fluid.

As this system works without the need for external energy for heating of the fluid (i.e. chemical packs or electric power are not needed) the need for fluid circulation present another problem that is overcome in the present invention by utilizing the user's 190 body movements 195 to transform to intermittent energy available for creating pump 55 fluid movement 75 by having the pump 55 preferably be in the form of a flexible bulb 70 disposed within a closely fitting backpack 200 that is secured 205 to the user 190, wherein the flexible bulb 70 of the pump 55 is intermittently compressed 80 and thus with the first 45 and second 90 check valve arrangement, the pump 55 will intermittently flow fluid 75 to the bleed valve 180 and back to the reservoir 40 as previously described, whether the bleed valve 180 is in the open operational state or the closed operational state. Note that intermittent flow 75 is sufficient as produced from the user 190 movement 195, making the heat transfer apparatus 30 for a portable hydration system 35 truly portable and self contained, not needing any replaceable chemical packs or batteries, in other words all the user 190 has to do is add water to the heat transfer apparatus 30 for a portable hydration system 35.

Also on the heat transfer apparatus 30 for a portable hydration system 35, can further comprise a third check valve 100 that is in fluid communication with the outlet end portion 145, wherein the third check valve 100 is oriented 105 such that flow is only allowed into the reservoir 40, wherein the third check valve 100 is operational to substantially cause the selectable intermittent fluid flowrate 185 to originate from the first fluid communication line 110 to further be operational to equalize the reservoir 40 and the bleed valve 180 temperatures. In other words, the third check valve 100 prevents the user 190 from drawing flow 185 from the second fluid communication line 135 and forces the user 190 to draw flow 185 from the first fluid communication line 110, thereby tending to put the relatively warmer fluid into the bleed valve 180 that is in the first fluid line 110 rather than the relatively colder fluid that is in the second fluid line 135, resulting in the bleed valve 180 being relatively warmer and more resistant to freezing.

CONCLUSION

Accordingly, the present invention of a heat transfer apparatus 30 in conjunction with the portable hydration system 35 has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. A heat transfer apparatus in combination with a portable hydration system, wherein said heat transfer apparatus and said portable hydration system combination are operationally secured to a user who is engaging in body movement, wherein said heat transfer apparatus and said portable hydration system combination including the user are located within an environment having freezing weather conditions, said heat transfer apparatus and said portable hydration system combination comprising:

(a) a reservoir containing a fluid;

(b) a first check valve in fluid communication with said reservoir, wherein said first check valve is oriented such that only flow from said reservoir is facilitated;

(c) a pump having an inlet port and an outlet port, wherein said inlet port is in fluid communication with said first check valve;

(d) a second check valve in communication with said outlet port, wherein said second check valve is oriented such that only flow from said pump is facilitated;

(e) a first fluid communication line including a proximal end portion and a distal end portion having a first fluid communication line length and first longitudinal axis therebetween, wherein said proximal end portion is in fluid communication with said second check valve;

(f) a second fluid communication line including an inlet end portion and an outlet end portion having a second fluid communication line length and second longitudinal axis therebetween, wherein said first fluid communication line length and said second fluid communication line length are continuously adjacent in position to one another, wherein said distal end portion and said inlet end portion are in fluid communication with one another and said outlet end portion is in fluid communication with said reservoir; and (g) a bleed valve in fluid communication with said distal end portion, wherein said bleed valve discharges a selectable intermittent fluid flowrate to the user for fluid consumption and said pump outputs a primary intermittent fluid flowrate that is greater than said intermittent fluid flowrate, wherein operationally said heat transfer apparatus acts to further help equalize said reservoir and said bleed valve temperatures through substantial continuous fluid circulation.

2. A combination heat transfer apparatus and portable hydration system according to claim 1 wherein said continuously adjacent position of said first fluid communication line and said second fluid communication line are further positioned such that said first fluid communication line and said second fluid communication line are in a co-axial positional relationship to one another as between said first longitudinal axis and said second longitudinal axis.

3. A combination heat transfer apparatus and portable hydration system according to claim 2 wherein said co-axial positional relationship is arranged such that said first fluid communication line is disposed within said second fluid communication line, being operational such that differential temperatures are minimized as between said first fluid communication line and said second fluid communication line.

4. A combination heat transfer apparatus and portable hydration system according to claim 1 wherein said pump is a manual structure type utilizing intermittent compressive force to provide energy for said primary intermittent fluid flowrate.

5. A combination heat transfer apparatus and portable hydration system according to claim 4 wherein said pump is sized and configured to create said intermittent compressive force from the user's body movement, wherein operationally said heat transfer apparatus and said portable hydration system function solely on user body movement.

6. A combination heat transfer apparatus and portable hydration system according to claim 5 wherein said sizing and configuring of said pump is accomplished by disposing said pump within a closely fitting backpack wherein said pump is in the form of a flexible bulb that is operationally intermittently compressed by said backpack following the user's bodily movement.

7. A combination heat transfer apparatus and portable hydration system according to claim 1 further comprising a third check valve that is in fluid communication with said outlet end portion, wherein said third check valve is oriented such that flow is only allowed into said reservoir, wherein said third check valve is operational to substantially cause said selectable intermittent fluid flowrate to originate from said first fluid communication line to further be operational to equalize said reservoir and said bleed valve temperatures.

8. A heat transfer apparatus in combination with a portable hydration system, wherein said heat transfer apparatus and said portable hydration system combination are operationally secured to a user who is engaging in body movement, wherein said heat transfer apparatus and said portable hydration system combination including the user are located within an environment having freezing weather conditions, said heat transfer apparatus and said portable hydration system combination comprising:

(a) a reservoir containing a fluid;

(b) a first check valve in fluid communication with said reservoir, wherein said first check valve is oriented such that only flow from said reservoir is facilitated;

(c) a pump having an inlet port and an outlet port, wherein said inlet port is in fluid communication with said first check valve;

(d) a second check valve in communication with said outlet port, wherein said second check valve is oriented such that only flow from said pump is facilitated;

(e) a first fluid communication line including a proximal end portion and a distal end portion having a first fluid communication line length and first longitudinal axis therebetween, wherein said proximal end portion is in fluid communication with said second check valve;

(f) a second fluid communication line including an inlet end portion and an outlet end portion having a second fluid communication line length and second longitudinal axis therebetween, wherein said first fluid communication line length and said second fluid communication line length are coaxial in positional relationship to one another as between said first longitudinal axis and said second longitudinal axis, said co-axial positional relationship is arranged such that said first fluid communication line is disposed within said second fluid communication line, being operational such that differential temperatures are minimized as between said first fluid communication line and said second fluid communication line, wherein said distal end portion and said inlet end portion are in fluid communication with one another and said outlet end portion is in fluid communication with said reservoir; and (g) a bleed valve in fluid communication with said distal end portion, wherein said bleed valve discharges a selectable intermittent fluid flowrate to the user for fluid consumption and said pump outputs a primary intermittent fluid flowrate that is greater than said intermittent fluid flowrate, wherein operationally said heat transfer apparatus acts to further help equalize said reservoir and said bleed valve temperatures through substantial continuous fluid circulation.

9. A combination heat transfer apparatus and portable hydration system according to claim 8 wherein said pump is a manual structural type utilizing intermittent compressive force to provide energy for said primary intermittent fluid flowrate.

10. A combination heat transfer apparatus and portable hydration system according to claim 9 wherein said pump is sized and configured to create said intermittent compressive force from the user's body movement, wherein operationally said heat transfer apparatus and said portable hydration system function solely on user body movement.

11. A heat transfer apparatus in combination with a portable hydration system, wherein said heat transfer apparatus and said portable hydration system combination are operationally secured to a user who is engaging in body movement, wherein said heat transfer apparatus and said portable hydration system combination including the user are located within an environment having freezing weather conditions, said heat transfer apparatus and said portable hydration system combination comprising:

(a) a reservoir containing a fluid;

(b) a first check valve in fluid communication with said reservoir, wherein said first check valve is oriented such that only flow from said reservoir is facilitated;

(c) a pump having an inlet port and an outlet port, wherein said inlet port is in fluid communication with said first check valve, said pump is a manual structure type utilizing intermittent compressive force to provide energy for said primary intermittent fluid flowrate, said pump is also sized and configured to create said intermittent compressive force from the user's body movement, wherein operationally said heat transfer apparatus and said portable hydration system function solely on user body movement;

(d) a second check valve in communication with said outlet port, wherein said second check valve is oriented such that only flow from said pump is facilitated;

(e) a first fluid communication line including a proximal end portion and a distal end portion having a first fluid communication line length and first longitudinal axis therebetween, wherein said proximal end portion is in fluid communication with said second check valve;

(f) a second fluid communication line including an inlet end portion and an outlet end portion having a second fluid communication line length and second longitudinal axis therebetween, wherein said first fluid communication line length and said second fluid communication line length are continuously adjacent in position to one another, wherein said distal end portion and said inlet end portion are in fluid communication with one another and said outlet end portion is in fluid communication with said reservoir; and (g) a bleed valve in fluid communication with said distal end portion, wherein said bleed valve discharges a selectable intermittent fluid flowrate to the user for fluid consumption and said pump outputs a primary intermittent fluid flowrate that is greater than said intermittent fluid flowrate, wherein operationally said heat transfer apparatus acts to further help equalize said reservoir and said bleed valve temperatures through substantial continuous fluid circulation.

12. A combination heat transfer apparatus and portable hydration system according to claim 11 wherein said continuously adjacent position of said first fluid communication line and said second fluid communication line are further positioned such that said first fluid communication line and said second fluid communication line are in a co-axial positional relationship to one another as between said first longitudinal axis and said second longitudinal axis.

13. A combination heat transfer apparatus and portable hydration system according to claim 12 wherein said co-axial positional relationship is arranged such that said first fluid communication line is disposed within said second fluid communication line, being operational such that differential temperatures are minimized as between said first fluid communication line and said second fluid communication line.

* * * * *